United States Patent [19]

Spinner et al.

[11] Patent Number: 4,757,291

[45] Date of Patent: Jul. 12, 1988

[54] COOLED WAVEGUIDE ASSEMBLY

[75] Inventors: Georg Spinner, Feldkirchen-Westerham; Franz-Xaver Pitschi, Rottach-Egern, both of Fed. Rep. of Germany

[73] Assignee: Spinner GmbH, Elektrotechnische Fabrik, Munich, Fed. Rep. of Germany

[21] Appl. No.: 18,420

[22] Filed: Feb. 24, 1987

[30] Foreign Application Priority Data

Feb. 28, 1986 [DE] Fed. Rep. of Germany ..... 3606627

[51] Int. Cl.[4] ..... H01P 1/04; H01P 3/12

[52] U.S. Cl. ..... 333/254; 333/239

[58] Field of Search ..... 333/239, 248, 22 R, 333/254–257

[56] References Cited

U.S. PATENT DOCUMENTS 3,030,592 4/1962 Lamb et al. ..... 333/22 F 3,201,725 8/1965 Johnson ..... 333/254

FOREIGN PATENT DOCUMENTS 46303 4/1981 Japan ..... 333/239

*Primary Examiner*—Paul Gensler

*Attorney, Agent, or Firm*—Henry M. Feiereisen

[57] ABSTRACT

A cooled waveguide assembly includes a plurality of extruded waveguides connected to each other via their respective flanged portion. Each waveguide has an outer profile corresponding to the outer dimensions of the flange portion which is created by suitably fabricating the end sections of each waveguide. The flange portion is provided with a plurality of boreholes which are in alignment with pockets to allow fasteners to be inserted therein so as to connect adjoining waveguides. Integrated in the wall of each waveguide are cooling channels which are arranged in such a manner that they do not intersect with the boreholes. The cooling channels and the interior of the waveguides are sealed at the respective joints by a profiled sealing element.

9 Claims, 3 Drawing Sheets

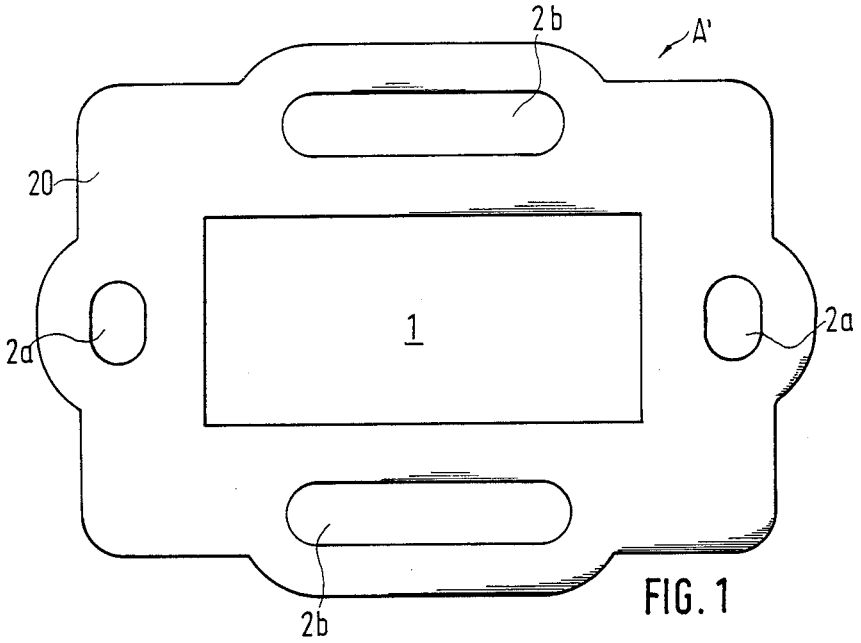
FIG. 1
FIG. 2
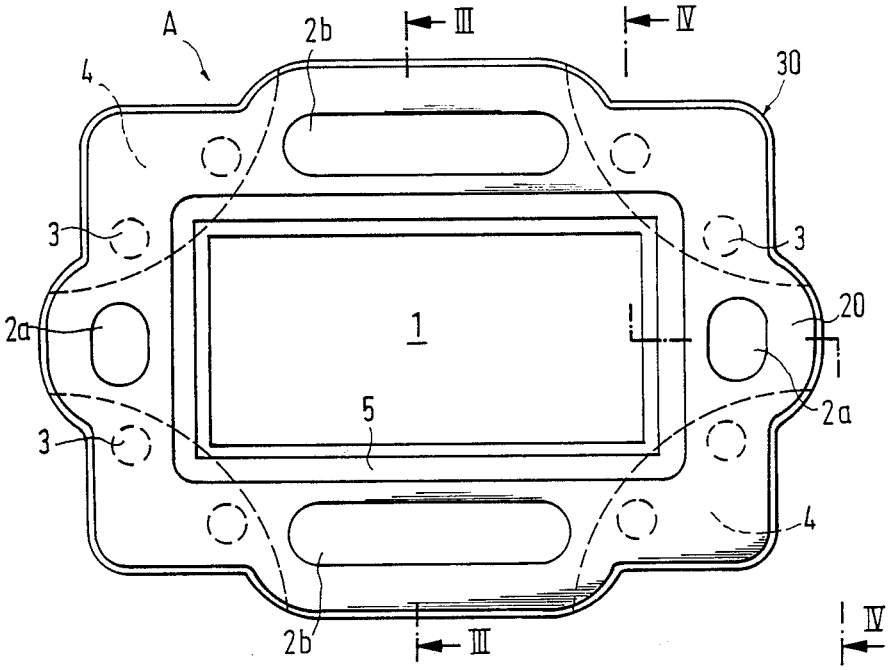

COOLED WAVEGUIDE ASSEMBLY

FIELD OF THE INVENTION

The present invention refers to a cooled waveguide assembly.

BACKGROUND OF THE INVENTION

Known waveguide assemblies include a plurality of waveguides which are screwed to each other via standardized end flanges. For eliminating excessive heat, cooling pipes are provided which are soldered to the side walls of the waveguides and extend parallel to the longitudinal axis of the latter. The cooling pipes of adjoining waveguides are connected to each other via short pipe bends or tube bends interposed between the angled ends of the cooling pipes.

Such cooled waveguide assemblies are used for transmitting rf-powers in the megawatt range. The time consuming and expensive manufacture of the waveguides and their assembly to a waveguide system is, however, disadvantageous. Further drawbacks reside in the different thermal expansion of the used materials of the waveguide and the cooling pipes so that e.g. with the increased number of required joints of cooling pipes a growing danger of leakages and an irregular cooling especially at the area of the flange connections are obtained thereby limiting the transmittable rf-power. Another drawback is the annealing of waveguides when brazing the flanges.

SUMMARY OF THE INVENTION

It is a principal object of the present invention to provide an improved waveguide assembly obviating the afore-stated drawbacks.

This object and others which will become apparent hereinafter are reailized by providing each waveguide with an outer profile corresponding to the outer dimensions of its flanged portion and which includes integrated cooling channels provided in such a manner that no intersection with those boreholes is obtained which are provided in the flanged portion to allow connections of adjoining waveguides.

Through the provision of such waveguides, a waveguide assembly with integrated cooling channels is created which is in simple manufactured manner through extrusion molding so that production costs and mounting costs are considerably reduced at improved cooling and operational reliability.

Each waveguide is of sufficient dimensions to allow fabrication of its end sections into a flanged portion via which adjoining waveguides are connected by e.g. fasteners like screws and nuts. The waveguide assembly according to the invention can thus be screwed together as easily as known standardized uncooled waveguides but includes in addition integrated cooling channels which achieve superior and more uniform cooling and can suitably be sealed when connecting the waveguides.

BRIEF DESCRIPTION OF THE DRAWING

The above and other objects, features and advantages of the present invention will now be described in more detail with reference to the accompanying drawing in which:

FIG. 1 is a front elevation view of one embodiment of a waveguide according to the invention with unifinished end section;

FIG. 2 is a front elevational view of the waveguide of FIG. 1 after fabrication of the end section into a flange;

SPECIFIC DESCRIPTION

Figure 3:
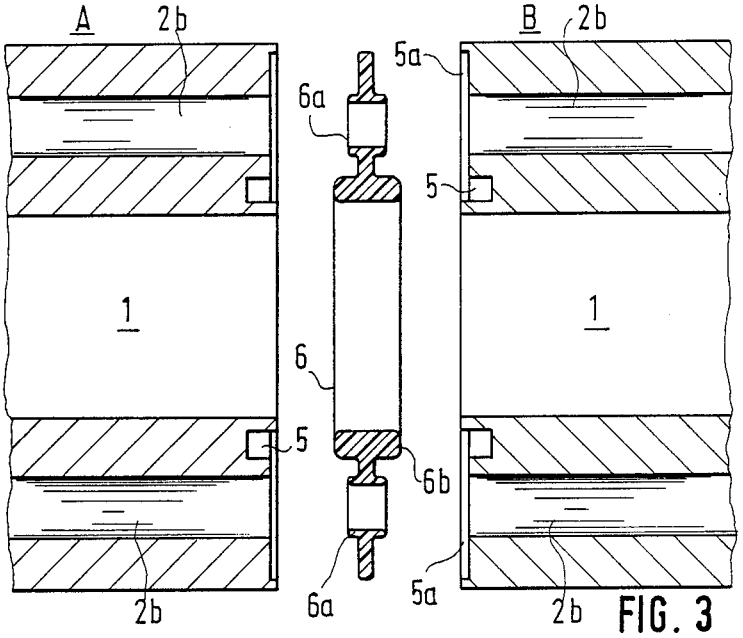
FIG. 3 is a longitudinal sectional view of two connected waveguides in accordance with FIG. 2 taken along the line III—III in FIG. 2.

Referring firstly to FIG. 1, there is shown a front elevational view of an extruded waveguide generally designated by reference numeral A' and shown in a still unfinished state in which the waveguide A' has an outer profile which essentially corresponds to the outer dimensions of a flanged portion to be provided by correspondingly fabricating the end section of the waveguide A'. Accommodated within the walls 20 of the waveguide A' and extending symmetrically to the rectangular interior 1 of the latter are cooling channels **2*a* and 2*b* of suitable cross section. Thus, in comparison to standardized waveguides, the waveguide A' is provided with considerably thicker walls 20**.

Turning now to FIG. 2, there is shown a front elevational view of a waveguide A in its finished state after fabricating the respective end section thereof into a flanged portion 30 for allowing adjoining waveguides A to be connected. The flanged portion 30 of each waveguide A is provided with several borholes 3, the coordinates of which optionally corresponding to those of standard flanges. The boreholes 3 are shown in broken lines and are spaced about the interior 1 within the wall 20 to define a raster structure. The cooling channels **2*a*, 2*b* extend within the walls 20 of the waveguide A in such manner that they do not intersect with the boreholes 3. Aligned with the boreholes 3 are pockets 4 which are milled into the wall 20 at a distance to the end face of the waveguide A. In FIG. 2, the pockets 4** are illustrated with their contour shown in broken line.

At its end face, the flanged portion 30 is provided with a groove 5 which extends within the raster structure as defined by the boreholes 3 and accommodates a suitable sealing. Such a sealing is required because waveguide systems of this kind usually operate at internal excess pressure. In the simplest case, the sealing is a suitable gasket.

A more advantageous alternative for the sealing is shown in FIG. 3 which illustrates a longitudinal sectional view of two waveguides A and B to be joined to each other. Inserted within the aligned grooves 5 of adjoining waveguides A, B is a gasket **6*b* for sealing the interior 1 of these waveguides A, B. The gasket 6*b* is part of a molded sealing 6 which includes in addition elastic sleeve-like sealing elements 6*a* insertable in grooves 5*a* and projecting into the open ends of the cooling channels 2*a*, 2*b* for sealing the latter after connecting the waveguides A, B. Instead of the shaped sealing 6 which is of one piece, it is also possible to seal the cooling channels 2*a*, 2*b*** at their joints by separate sleeve-like sealing elements or gaskets which then are insertable within grooves still to be provided.

Figure 4:
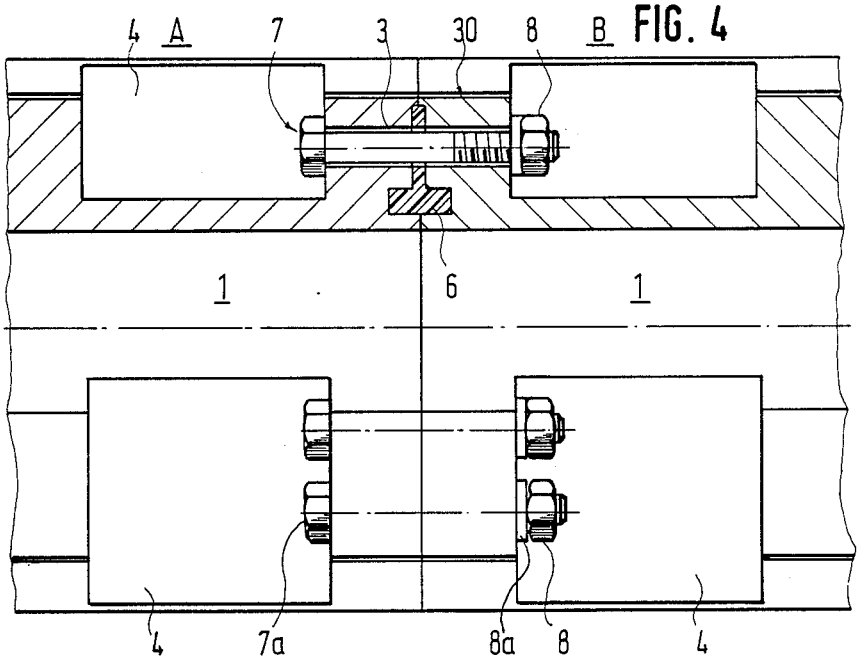
FIG. 4 is a partial longitudinal sectional view of two connected waveguides in accordance with FIG. 2 taken along the line IV—IV in FIG. 2.

As shown in FIG. 4, the waveguides A, B are connected to each other via their respective flanged portions 30. The boreholes 3 of the adjoining waveguides A, B are aligned with each other and extend between the respective end faces of the waveguides A, B and the pockets 4. When connecting adjoining waveguides such as the waveguides A, B in FIG. 4, suitable screws 7 are inserted through the pockets 4 of waveguide A into the boreholes 3 with their heads 7*a* abutting against the respective flanged portion 30 and are tightened by nuts 8 and washers 8*a* which are inserted through the pockets 4 of the other waveguide B.

Figure 5:
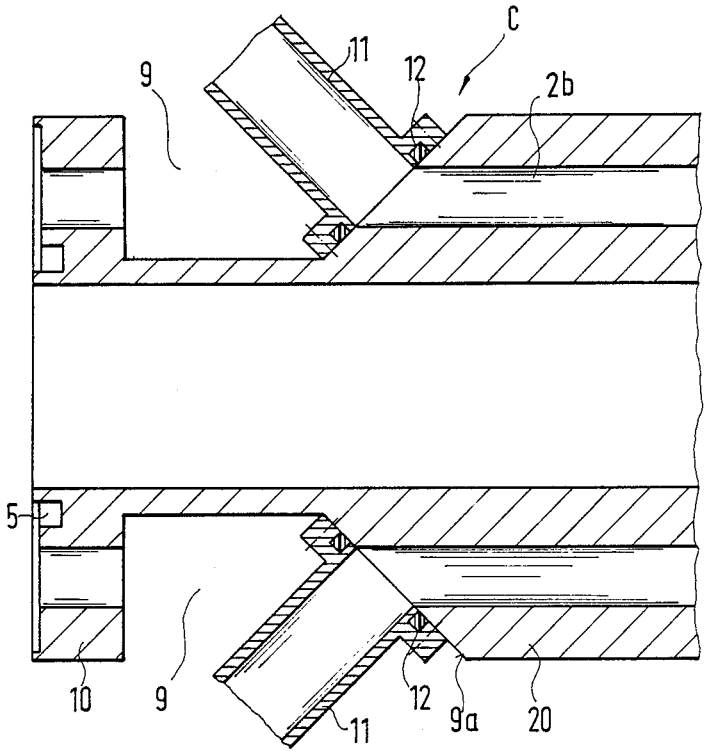
FIG. 5 is a longitudinal sectional view of another embodiment of a waveguide according to the invention.

In case a connection for supply and return of coolant is to be provided, recesses can be arranged in addition to or instead of the pockets 4. Turning thus to FIG. 5 which illustrates a longitudinal section of a further embodiment of a waveguide C according to the invention in which the pockets 4 are substituted by a circumferential recess 9.

The recess 9 is milled into the wall 20 at a distance to the end face of the waveguide C so that a circumferential flanged portion 10 is defined. The surface of the recess 9 remote to the end face of the waveguide C is beveled in order to simplify attachment of a connecting pipe 11 to the exposed ends of the cooling channels 2*b*. Leakage of coolant is prevented by suitable sealings 12.

Instead of being used as a coolant supply or coolant discharge, the connecting pipes 11 may also link the respective cooling channels of one waveguide with the cooling channels of an adjoining waveguide by bypassing the flanged connection.

While the invention has been illustrated and described as embodied in a Cooled Waveguide System, it is not intended to be limited to the details shown since various modifications and structural changes may be made without departing in any way from the spirit of my present invention.

What is claimed as new and desired to be protected by Letters Patent is set forth in the appended claims:

1. A waveguide assembly, comrising: a plurality of waveguides, each defining an axis and having an end section shaped in such a manner that an integrated standardized flanged portion is defined which is adapted for connection with a flanged portion of a further such waveguide, each said flanged portion including a plurality of boreholes via which said flanged portions are connected to each other, the remaining section of said waveguide having in its unfinished state an outer profile essentially corresponding to the outer dimensions of said flanged portion and accommodating integrated cooling channels which extend parallel to said axis without intersecting said boreholes.

2. A waveguide assembly according to claim 1 wherein each of said waveguides has an interior and includes an end face provided with a standardized groove so that a common groove is defined when adjoining two such waveguides, and further comprising a sealing element insertable in said common groove for obtaining a sealed connection of said interior of said adjoining waveguides.

3. A waveguide assembly as defined in claim 2 wherein said boreholes are spaced about said interior of each waveguide to define a raster, said groove of each waveguide being arranged within said raster.

4. A waveguide assembly as defined in claim 2 wherein said end face of each waveguide is provided with further grooves, and further comprising elastic sleeve-type sealing engaging said grooves and projecting into said cooling channels for sealing said cooling channels of said adjoining waveguides.

5. A waveguide assembly as defined in claim 1 wherein each of said waveguides has an interior and includes an end face, and further comprising a molded sealing element of profiled cross section arranged between said end faces of adjoining waveguides for sealing said interiors and said cooling channels at their respective joints.

6. A waveguide assembly as defined in claim 5 wherein each of said waveguides has an end face provided with a groove, said sealing element having at least one profiled section arranged in said groove of at least one of said end faces of said adjoining waveguides.

7. A waveguide assembly as defined in claim 1 wherein each of said waveguides has an end face and includes a plurality of pockets extending at a distance to said end face, said pockets being aligned with said boreholes without intersecting said cooling channels, and further comprising fastening means insertable through said boreholes via said pockets for connecting adjoining waveguides to each other.

8. A waveguide assembly as defined in claim 1 wherein each of said waveguides has an end face and includes a circumferential recess at a distance to said end face, and further comrising connecting pipes arranged in said recess and communicating with said cooling channels.

9. A waveguide assembly as defined in claim 8 wherein said recess is in connection with said boreholes, and further comprising fastening means for connecting adjoining waveguides, said fastening means being insertable through said boreholes via said recess.

* * * * *